US007806358B2

(12) United States Patent
Hoover

(10) Patent No.: US 7,806,358 B2
(45) Date of Patent: Oct. 5, 2010

(54) YARN TENSION CONTROL DEVICE

(75) Inventor: Donald Lynn Hoover, Clover, SC (US)

(73) Assignee: American Linc Corporation, Gastonia, NC (US)

( * ) Notice: Subject to any disclaimer, the term of this patent is extended or adjusted under 35 U.S.C. 154(b) by 19 days.

(21) Appl. No.: 11/999,214

(22) Filed: Dec. 4, 2007

(65) Prior Publication Data

US 2009/0140092 A1 Jun. 4, 2009

(51) Int. Cl.
*B65H 59/10* (2006.01)

(52) U.S. Cl. ..... 242/419.4; 242/149

(58) Field of Classification Search ..... 242/419, 242/419.1, 419.4, 419.5, 419.6, 419.7, 149, 242/151, 152, 153, 154; 226/195
See application file for complete search history.

(56) References Cited

U.S. PATENT DOCUMENTS

| | | | | | |
|---|---|---|---|---|---|
| 2,667,313 | A | | 1/1954 | Klein | |
| 2,864,566 | A | * | 12/1958 | Klein | 242/153 |
| 2,922,598 | A | * | 1/1960 | Heijnis | 242/154 |
| 3,293,839 | A | * | 12/1966 | Yanobu | 57/58.86 |
| 3,853,410 | A | * | 12/1974 | Busoni | 401/1 |
| 3,933,318 | A | | 1/1976 | Yajima et al. | |
| 3,966,133 | A | * | 6/1976 | Gelin | 242/472.8 |
| 3,999,724 | A | | 12/1976 | Haring et al. | |
| 4,121,781 | A | | 10/1978 | Angst | |
| 4,135,679 | A | * | 1/1979 | Murphy et al. | 242/128 |
| 4,165,056 | A | | 8/1979 | Singer | |
| 4,313,578 | A | | 2/1982 | Van Wilson et al. | |
| 4,605,182 | A | | 8/1986 | Zollinger | |
| 4,858,839 | A | | 8/1989 | Niederer | |
| 5,639,036 | A | | 6/1997 | Flamm | |
| 6,945,490 | B1 | | 9/2005 | Zollinger | |

* cited by examiner

*Primary Examiner*—William E Dondero
(74) *Attorney, Agent, or Firm*—Schwartz Law Firm, P.C.

(57) ABSTRACT

A yarn tension control device controls tension in a running yarn. The tension control device includes a housing having a yarn guiding inlet for receiving running yarn at an unwinding tension from a yarn supply source, and a yarn guiding outlet for guiding running yarn exiting the housing at a delivery tension. First and second opposing yarn engaging surfaces are disposed between the inlet and the outlet, and are adapted to frictionally engage opposite sides of the running yarn along a path of yarn travel through the housing. The first and second yarn engaging surfaces define a respective plurality of sequentially spaced friction rolls. A biasing assembly resiliently urges the first and second yarn engaging surfaces together. The opposing friction rolls cooperate to form a number of sequentially spaced nip points adapted to adjust yarn delivery tension in response to stress variations in running yarn entering the housing.

23 Claims, 5 Drawing Sheets

YARN TENSION CONTROL DEVICE

TECHNICAL FIELD AND BACKGROUND

The present disclosure relates broadly to the textile industry, and more specifically, to a yarn tension control device which compensates for stress variations in running yarn. One cause of stress variation relates directly to the shrinking size of the yarn supply package as yarn is unwound and pulled downstream to a textile machine. In one exemplary implementation, the present invention adjusts unwinding tension in the running yarn in order to achieve a more uniform and constant delivery tension to the textile machine.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

One object of the exemplary embodiments described herein is to provide an improved tension control device which delicately senses stress variations in a running yarn, which reacts to such variations so as to augment or to reduce friction resistance on the yarn for establishing a desired uniform tension therein, especially in response to variations of unwinding tension of the supply yarn source.

According to one exemplary embodiment, the invention may comprise a yarn tension control device for controlling tension in a running yarn. The tension control device includes a housing having a yarn guiding inlet for receiving running yarn at an unwinding tension from a yarn supply source, and a yarn guiding outlet for guiding running yarn exiting the housing at a delivery tension. First and second opposing yarn engaging surfaces are disposed between the inlet and the outlet, and are adapted to frictionally engage opposite sides of the running yarn along a path of yarn travel through the housing. The first and second yarn engaging surfaces define a respective plurality of sequentially spaced friction rolls. Means are provided for resiliently urging the first and second yarn engaging surfaces together. The opposing friction rolls cooperate to form a plurality of sequentially spaced nip points adapted to adjust yarn delivery tension in response to stress variations in running yarn entering the housing. As such, greater frictional resistance is applied at the nip points to running yarn entering the housing at a relatively low degree of unwinding tension, and lesser frictional resistance is applied at the nip points to running yarn entering the housing at a relatively high degree of unwinding tension.

Use of the terms "upstream" and "downstream" refer herein to relative locations (or movement) of elements or structure to other elements or structure along or adjacent the path of yarn travel. In other words, a first element or structure which is encountered along or adjacent the path of yarn travel before a second element or structure is considered to be "upstream" of the second element or structure, and the second element structure is considered to be "downstream" of the first.

The term "sequentially spaced" is defined herein to mean the physical and/or temporal spacing of elements or structure downstream along or adjacent the path of yarn travel.

The term "housing" refers broadly herein to any open, closed, or partially open or partially closed structure.

According to another exemplary embodiment, a pivoted rocker block is carried by the housing, and the first yarn engaging surface is defined by an inside surface of the rocker block.

According to another exemplary embodiment, the second yarn engaging surface is defined by a fixed inside wall of the housing adjacent the first yarn engaging surface defined by the rocker block.

According to another exemplary embodiment, the yarn guiding inlet of the housing is longitudinally offset from the sequentially spaced nip points along the path of yarn travel.

The term "longitudinally offset" is defined herein to mean located a laterally spaced distance outside a longitudinal path of otherwise straight travel between two spaced points.

According to another exemplary embodiment, the rocker block is mounted at a pivot point located upstream of the nip points and adjacent a second inside wall of the housing opposite the second yarn engaging surface.

According to another exemplary embodiment, the rocker block defines a second inside surface extending at an angle downstream from the pivot point to the first yarn engaging surface, and wherein the rocker block has a center of gravity spaced downstream from the pivot point.

According to another exemplary embodiment, the yarn guiding outlet of the housing is longitudinally offset from the sequentially spaced nip points along the path of yarn travel.

According to another exemplary embodiment, the friction rolls of the first and second yarn engaging surfaces are in substantial registration on opposite sides of the running yarn when the surfaces are resiliently urged together. Upon slight pivoting movement of the rocker block, the friction rolls of the second yarn engaging surface shift (outwardly and longitudinally) along the path of yarn travel relative to the friction rolls of the first yarn engaging surface, thereby reducing frictional resistance applied to the running yarn.

According to another exemplary embodiment, the means for resiliently urging the first and second yarn engaging surfaces together includes a compression spring.

According to another exemplary embodiment, the compression spring is axially oriented to create a biasing force acting adjacent the sequentially spaced nip points defined by the first and second yarn engaging surfaces.

According to another exemplary embodiment, means are provided for selectively adjusting the biasing force created by the compression spring.

According to another exemplary embodiment, the means for selectively adjusting the biasing force includes a rotatable cam wheel and spring-engaging ball.

According to another exemplary embodiment, the cam wheel defines a number of circumferentially spaced recessed cam surfaces of varying depth.

According to another exemplary embodiment, a yarn cleaner is located upstream of the housing.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter-with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at lease one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterite) is not intended to indicate or imply that the invention has been previously reduced to practice or that any testing has been performed.

Figure 1:
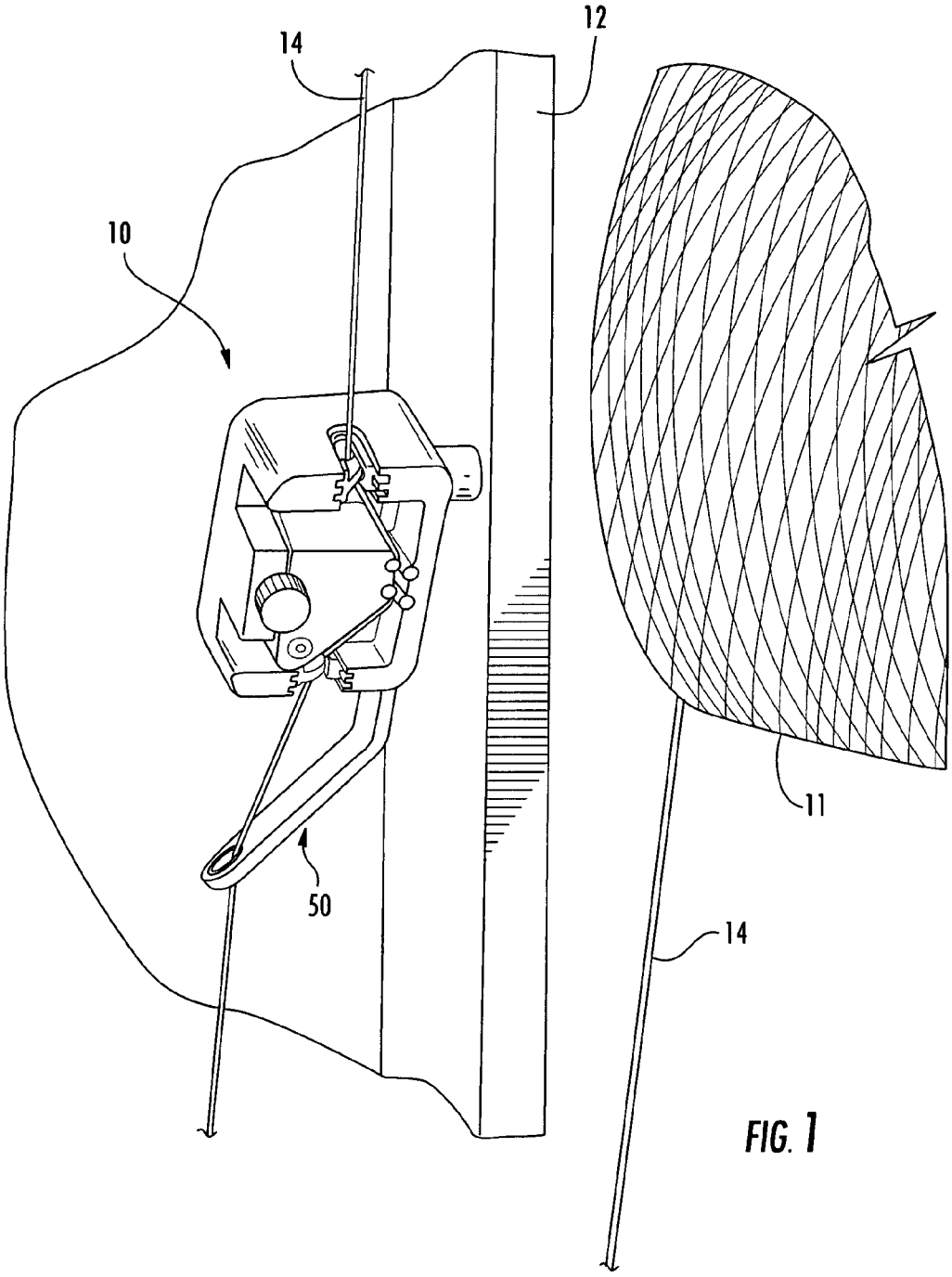
FIG. 1 is an environmental perspective view of a yarn tension control device according to one exemplary embodiment of the present invention.

Referring now specifically to the drawings, a yarn tension control device according to one exemplary embodiment of the present invention is illustrated in FIG. 1 and shown generally at reference numeral 10. The exemplary tension control device 10 is located between an upstream yarn supply package 11 (e.g., bobbin) and a downstream textile machine, and may be vertically mounted on a frame member 12 attached to a creel or structural component of the textile machine. The tension control device 10 is applicable for use in combination with any textile machine, such as a yarn cabler, and other machines that utilize yarn in the manufacture or processing of a textile product.

As running yarn 14 is pulled from the supply package 11 to the textile machine, the interposed tension control device 10 applies varying resistance to the yarn 14 by friction engagement that varies in response to the unwinding (or incoming) tension in running yarn 14 entering the device 10, such that the delivery tension of running yarn 14 exiting the device 10 is maintained at a relatively uniform and constant level. Thus, the tension control device 10 applies greater frictional resistance to running yarn 14 that is initially at a low degree of unwinding tension, and applies lesser frictional resistance to running yarn 14 of higher unwinding tension. The frictional restraint is responsive to variations in yarn tension to increase or decrease the tension as a result of the amount of deflection in the yarn.

Figure 2:
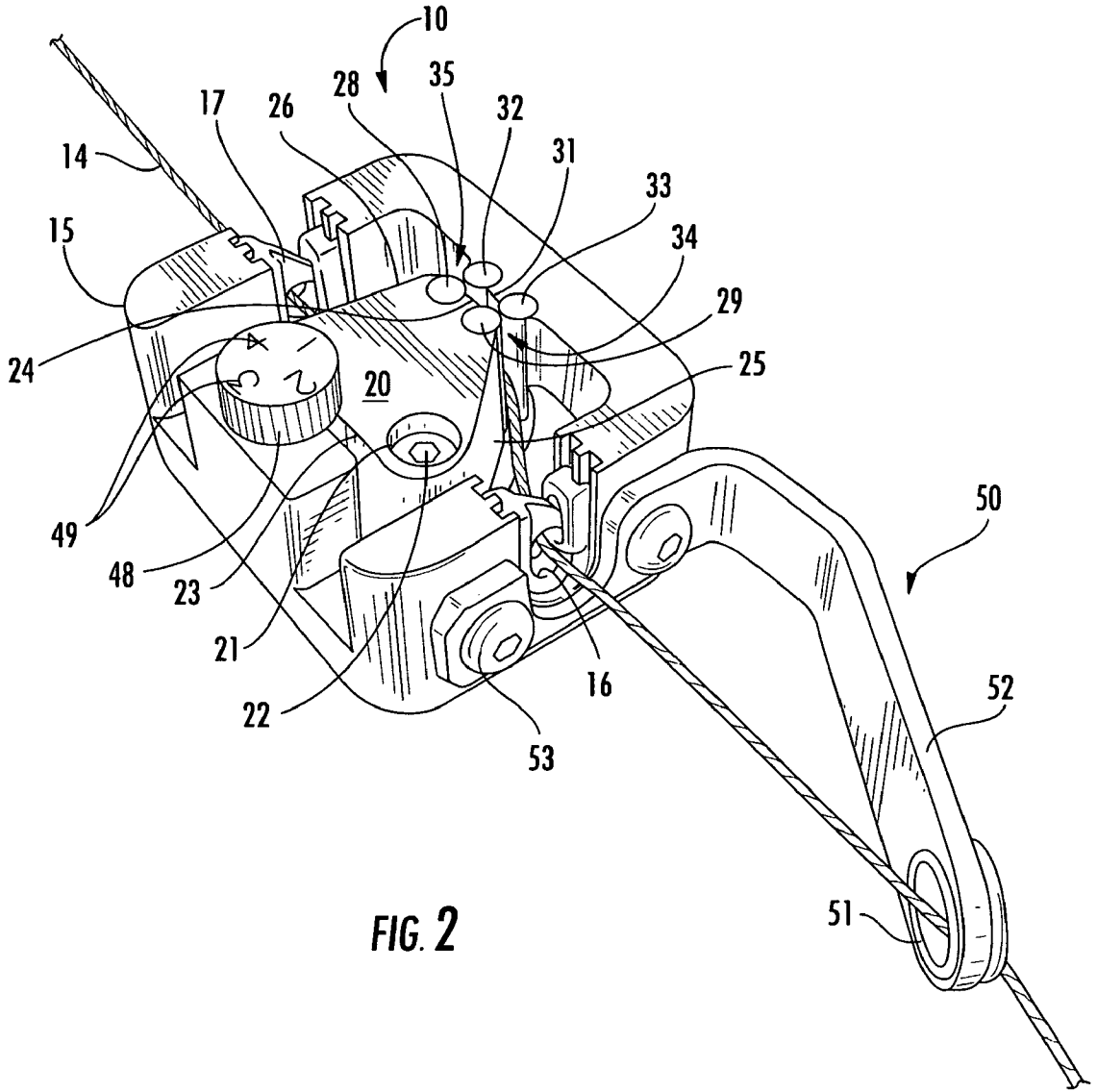
FIG. 2 is a further perspective view of the yarn tension control device.
Figure 3:
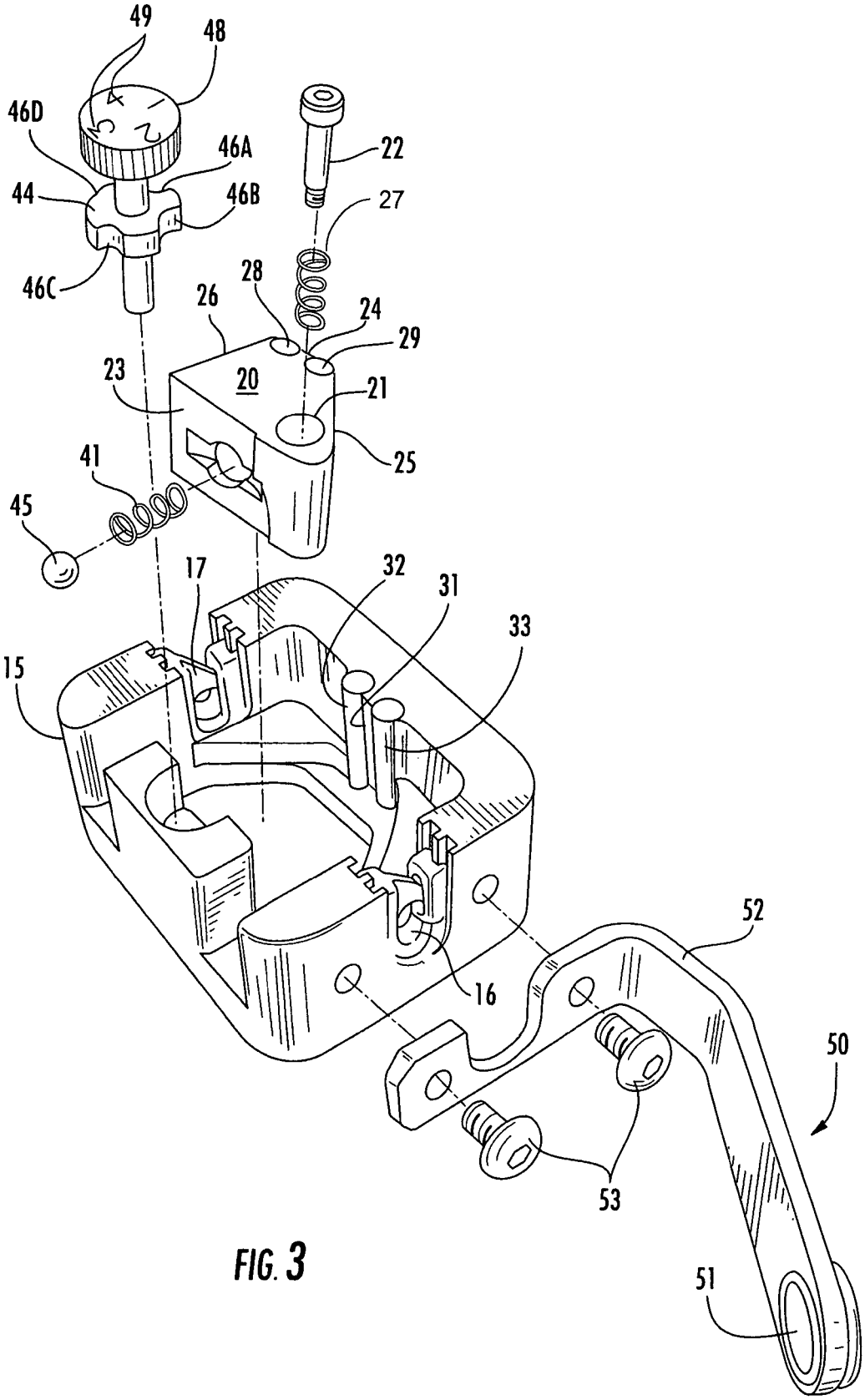
FIG. 3 is an exploded view of the yarn tension control device.

Referring now to FIGS. 1, 2, and 3, the exemplary yarn tension control device 10 comprises a generally open-structure housing 15 having a yarn guiding inlet 16 for receiving running yarn 14 entering the housing 15 at an unwinding tension from the yarn supply package 11, and a yarn guiding outlet 17 for guiding the running yarn 14 exiting the housing 15 at a delivery tension to the downstream textile machine (not shown). A pivoted rocker block 20 is carried by the housing 15, and located between the yarn inlet 16 and yarn outlet 17. The rocker block 20 is pivotably mounted at a front end pivot point 21 via threaded pin 22 (e.g., shoulder bolt), and has a generally trapezoidal shape with opposite sides 23 and 24 being substantially parallel and sides 25 and 26 being non-parallel. A compression spring 27 may reside between the annular shoulder of pin 22 and an annular interior surface (not shown) of the rocker block 20 to resiliently urge and tension the rocker block 20 inside the housing 15, and thereby limit its vibration during operation of the yarn tension control device 10. Block side 25 of the rocker block extends from the front end at an angle ($\alpha$) of approximately 45 degrees (See FIG. 4) to the side 23.

The side 24 (or inside surface) of the rocker block 20 is longitudinally offset from the yarn inlet 16 and defines a first yarn engaging surface comprising multiple, sequentially-spaced friction rolls 28 and 29. The friction rolls 28, 29 may be either separately or integrally formed with the rocker block 20, and may be rotatable or fixed. In one embodiment, the friction rolls 28, 29 are separately formed and comprise a generally wear-resistant material, such as a ceramic. The first yarn engaging surface 24 of the rocker block 20 cooperates with a second yarn engaging surface 31 defined by a fixed inside wall of the housing 15 and a biasing force, described below, to frictionally engage opposite sides of the running yarn 14 along its path of travel through the housing 15. The second yarn engaging surface 31 may have identical friction rolls 32 and 33 arranged in substantial registration with friction rolls 28, 29 on opposite sides of the running yarn 14, such that respective pairs of friction rolls 28, 32 and 29, 33 cooperate to form sequentially spaced and resiliently biased nip points 34 and 35. The nip points 34, 35 are longitudinally offset from the yarn inlet 16 and yarn outlet 17 of the housing 15, and adjust to vary tension in the running yarn 14. In one implementation, the nip points 34, 35 cooperate to delicately adjust yarn delivery tension in response to stress variations in running yarn 14 entering the housing 15, such that greater frictional resistance is applied at the nip points 34, 35 to running yarn 14 at a relatively low degree of unwinding tension, and lesser frictional resistance is applied at the nip points 34, 35 to running yarn 14 at a relatively high degree of unwinding tension. While the present embodiment utilizes two sequentially spaced nip points 34, 35, it is understood that additional spaced nip points may be added in achieving the desired yarn tension control.

Figure 4:
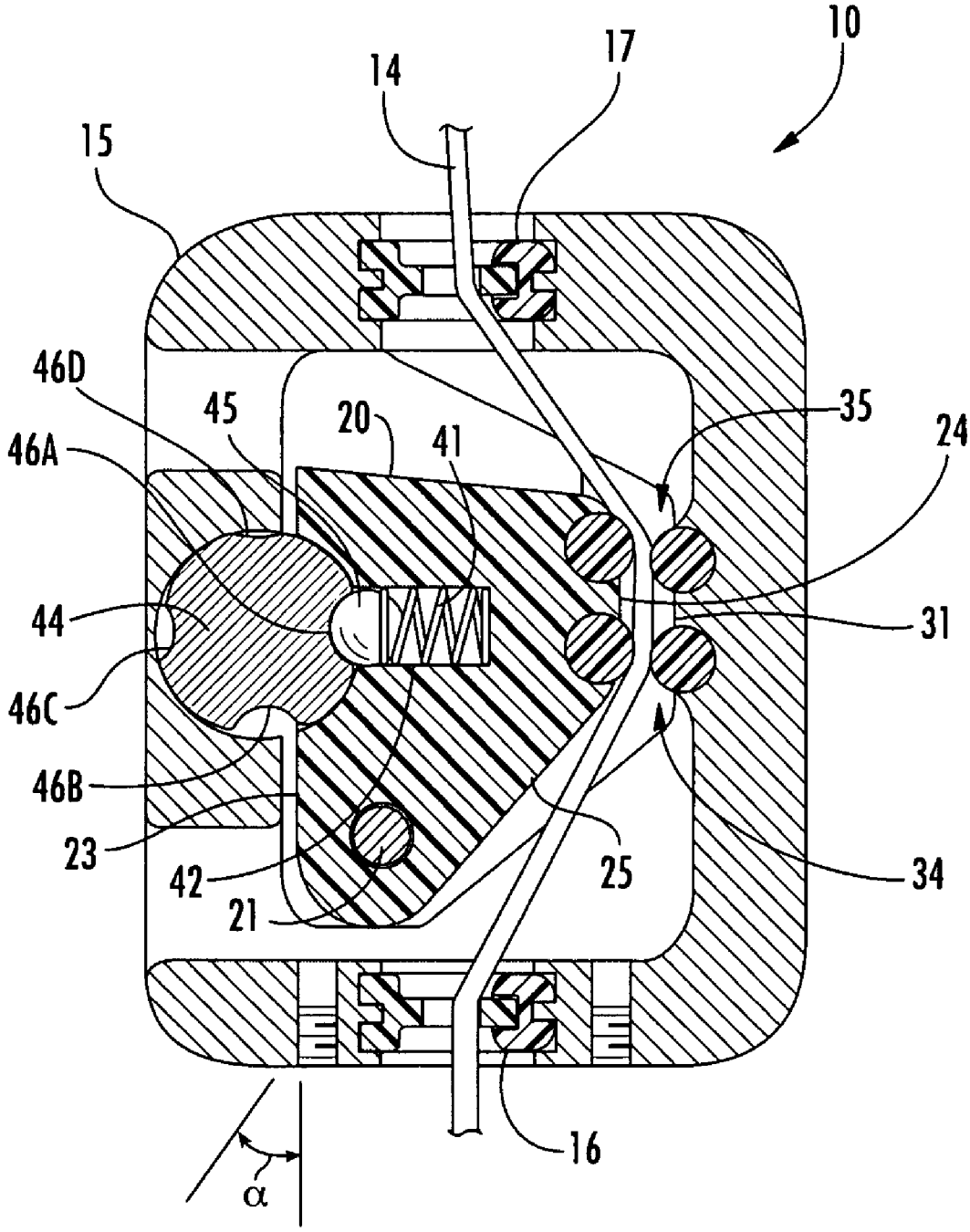
FIG. 4 is a cross-sectional view of the yarn tension control device with the cam wheel indexed at a position of minimum frictional resistance.
Figure 5:
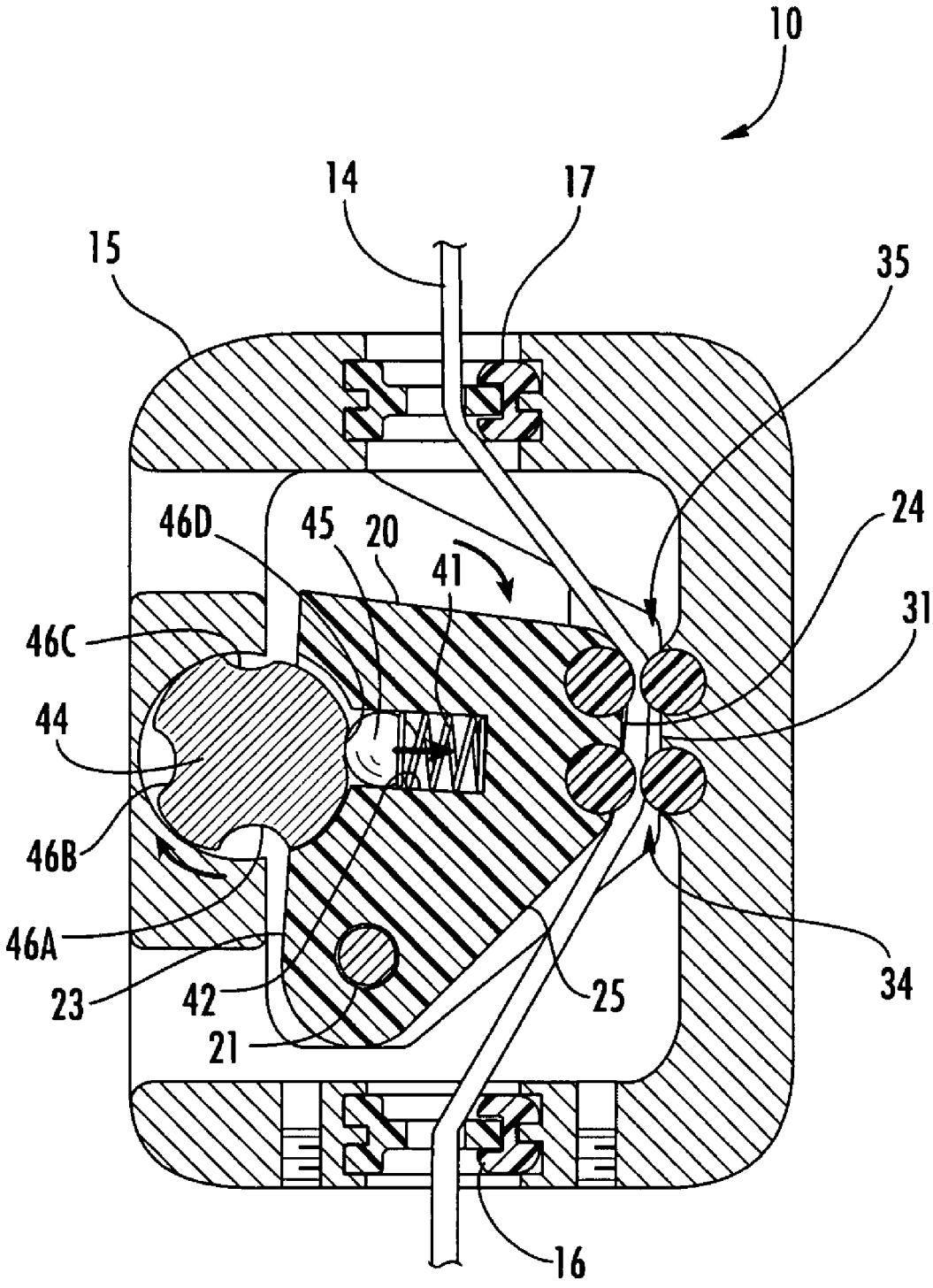
FIG. 5 is a further cross-sectional view of the yarn tension control device with the cam wheel indexed at a position of maximum frictional resistance.

As best shown in FIGS. 4 and 5, the rocker block 20 is resiliently urged towards the inside wall of the housing 15 using a compression spring 41 (or other biasing means), thereby urging the first and second yarn engaging surfaces 24, 31 together on opposite sides of the running yarn 14. In the embodiment shown, the compression spring 41 is axially oriented inside a cylindrical opening 42 formed with the rocker block 20, and operates to direct a biasing force along a notional line extending through an area of the nip points 34, 35. The degree of biasing force may be selectively adjusted or indexed using a rotatable cam wheel 44 and spring-engaging ball 45. The cam wheel 44 has a number of circumferentially-spaced, recessed cam surfaces 46A, 46B, 46C, and 46D of varying depth. The cam surfaces 46A-46D are designed to receive the ball 45, such that deeper surfaces 46A, 46B cause less compression of the spring 41 and result in less force acting against the rocker block 20. In this case, the sensitivity of the nip points 34, 35 to tension variation increases. FIG. 4 shows the cam wheel 44 indexed at a position of minimum frictional resistance. Conversely, the more shallow cam surfaces 46C, 46D cause increased compression of the spring 41, and result in greater force acting against the rocker block 20 and less sensitive nip points 34, 35. FIG. 5 shows the cam wheel 44 indexed at a position of maximum frictional resistance. For added convenience, the cam wheel 44 may further comprise a manual turn knob 48 and indexing indicia 49, shown in FIGS. 2 and 3, used to select the desired degree of spring compression (or biasing force). In this embodiment, the center of gravity of the rocker block 20 is spaced away (or downstream) of the pivot point 21, and in an area of the nip points 34, 35.

In addition to the above, the tension control device 10 may include a separately attached yarn cleaner 50 (and "de-tangler") comprising a yarn receiving eyelet 51 and support arm 52 attached to the housing 15 using hardware 53, such as screws. The eyelet 51 is located upstream of the housing 15 in the path of yarn travel, and frictionally engages the running yarn 14 to clean and de-tangle the yarn 14 before the yarn 14 passes into and through the housing inlet 16.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A yarn tension control device for controlling tension in a running yarn, said tension control device comprising:

a housing having a yarn guiding inlet for receiving running yarn at an unwinding tension from a yarn supply source, and a yarn guiding outlet for guiding the running yarn exiting said housing at a delivery tension;

first and second opposing yarn engaging surfaces disposed between said inlet and said outlet, and adapted to frictionally engage opposite sides of the running yarn along a path of yarn travel through said housing;

said first and second yarn engaging surfaces defining a respective plurality of sequentially spaced friction rolls downstream of said yarn guiding inlet;

a pivoted rocker block carried by said housing, and wherein said first yarn engaging surface is defined by an inside surface of said rocker block, and wherein said rocker block comprises a single pivot point, and said pivot point being located upstream of a leading one of said friction rolls; and means for resiliently urging said first and second yarn engaging surfaces together, wherein said opposing friction rolls cooperate to form a plurality of sequentially spaced nip points adapted to adjust yarn delivery tension in response to stress variations in running yarn entering said housing, such that greater frictional resistance is applied at said nip points to running yarn entering said housing at a relatively low degree of unwinding tension, and lesser frictional resistance is applied at said nip points to running yarn entering said housing at a relatively high degree of unwinding tension.

2. A yarn tension control device according to claim 1, wherein said second yarn engaging surface is defined by a fixed inside wall of said housing adjacent the first yarn engaging surface defined by said rocker block.

3. A yarn tension control device according to claim 2, wherein the yarn guiding inlet of said housing is longitudinally offset from the sequentially spaced nip points along the path of yarn travel.

4. A yarn tension control device according to claim 3, wherein said rocker block is mounted adjacent a second inside wall of said housing opposite said second yarn engaging surface.

5. A yarn tension control device according to claim 4, wherein said rocker block defines a second inside surface extending at an angle downstream from the pivot point to said first yarn engaging surface, and wherein said rocker block has a center of gravity spaced downstream from the pivot point.

6. A yarn tension control device according to claim 5, wherein the yarn guiding outlet of said housing is longitudinally offset from the sequentially spaced nip points along the path of yarn travel.

7. A yarn tension control device according to claim 6, wherein the friction rolls of said first and second yarn engaging surfaces are in substantial registration on opposite sides of the running yarn, and upon pivoting movement of said rocker block, the friction rolls of said first yarn engaging surface shift along the path of yarn travel relative to the friction rolls of the second yarn engaging surface, thereby reducing frictional resistance applied to the running yarn.

8. A yarn tension control device according to claim 1, wherein said means for resiliently urging said first and second yarn engaging surfaces together comprises a compression spring.

9. A yarn tension control device according to claim 8, wherein said compression spring is axially oriented to create a biasing force acting adjacent the sequentially spaced nip points defined by the first and second yarn engaging surfaces.

10. A yarn tension control device according to claim 9, and comprising means for selectively adjusting the biasing force created by said compression spring.

11. A yarn tension control device according to claim 10, wherein said means for selectively adjusting the biasing force comprises a rotatable cam wheel and spring-engaging ball.

12. A yarn tension control device according to claim 11, wherein said cam wheel defines a plurality of circumferentially spaced cam surfaces of varying depth.

13. A yarn tension control device according to claim 1, and comprising a yarn cleaner located upstream of said housing.

14. A yarn tension control device for controlling tension in a running yarn, said tension control device comprising:

a housing having a yarn guiding inlet for receiving running yarn at an unwinding tension from a yarn supply source, and a yarn guiding outlet for guiding the running yarn downstream at a delivery tension;

a pivoted rocker block carried by said housing, and defining a first yarn engaging surface, and wherein said rocker block comprises a single pivot point, and said pivot point being located upstream of said first yarn engaging surface;

a second yarn engaging surface defined by a fixed inside wall of said housing adjacent the first yarn engaging surface of said rocker block, and said first and second yarn engaging surfaces cooperating to frictionally engage opposite sides of the running yarn along a path of travel through said housing;

said first and second yarn engaging surfaces defining a respective plurality of sequentially spaced friction rolls downstream of said yarn guiding inlet;

means for resiliently urging said first yarn engaging surface of said rocker block towards said second yarn engaging surface of said housing, wherein said opposing friction rolls cooperate to form a plurality of sequentially spaced nip points adapted to adjust yarn delivery tension in response to stress variations in running yarn entering said housing, such that greater frictional resistance is applied at said nip points to running yarn at a relatively low degree of unwinding tension, and lesser frictional resistance is applied at said nip points to running yarn at a relatively high degree of unwinding tension;

wherein said yarn guiding inlet and said yarn guiding outlet are both longitudinally offset from the sequentially spaced nip points along the path of yarn travel through said housing; and a yarn cleaner located upstream of said housing.

15. A yarn tension control device according to claim 14, wherein said means for resiliently urging said first and second yarn engaging surfaces together comprises a compression spring, said compression spring being axially oriented to create a biasing force acting adjacent the sequentially spaced nip points.

16. A yarn tension control device according to claim 15, and comprising means for selectively adjusting the biasing force created by said compression spring.

17. A yarn tension control device according to claim 16, wherein said means for selectively adjusting the biasing force comprises a rotatable cam wheel and spring-engaging ball.

18. A yarn tension control device according to claim 17, wherein said cam wheel defines a plurality of circumferentially spaced cam surfaces of varying depth.

19. In combination with a textile machine, a yarn tension control device for controlling tension in a running yarn, said tension control device comprising:

a housing having a yarn guiding inlet for receiving running yarn at an unwinding tension from a yarn supply source, and a yarn guiding outlet for guiding the running yarn downstream at a delivery tension;

first and second opposing yarn engaging surfaces disposed between said inlet and said outlet, and adapted to frictionally engage opposite sides of the running yarn along a path of travel through said housing;

said first and second yarn engaging surfaces defining a respective plurality of sequentially spaced friction rolls downstream of said yarn guiding inlet;

a pivoted rocker block carried by said housing, and wherein said first yarn engaging surface is defined by an inside surface of said rocker block, and wherein said rocker block comprises a single pivot point, and wherein said pivot point is located upstream of a leading one of said friction rolls; and means for resiliently urging said first and second yarn engaging surfaces together, wherein said opposing friction rolls cooperate to form a plurality of sequentially spaced nip points adapted to adjust yarn delivery tension in response to stress variations in running yarn entering said housing, such that greater frictional resistance is applied at said nip points to running yarn at a relatively low degree of unwinding tension, and lesser frictional resistance is applied at said nip points to running yarn at a relatively high degree of unwinding tension.

20. A yarn tension control device for controlling tension in a running yarn, said tension control device comprising:

a housing having a yarn guiding inlet for receiving running yarn at an unwinding tension from a yarn supply source, and a yarn guiding outlet for guiding the running yarn exiting said housing at a delivery tension;

first and second opposing yarn engaging surfaces disposed between said inlet and said outlet, and adapted to frictionally engage opposite sides of the running yarn along a path of yarn travel through said housing;

said first and second yarn engaging surfaces defining a respective plurality of sequentially spaced friction rolls;

a compression spring within said housing for resiliently urging said first and second yarn engaging surfaces together, wherein said opposing friction rolls cooperate to form a plurality of sequentially spaced nip points adapted to adjust yarn delivery tension in response to stress variations in running yarn entering said housing, and said compression spring being axially oriented to create a biasing force acting adjacent the sequentially spaced nip points, such that greater frictional resistance is applied at said nip points to running yarn entering said housing at a relatively low degree of unwinding tension, and lesser frictional resistance is applied at said nip points to running yarn entering said housing at a relatively high degree of unwinding tension; and a rotatable cam wheel and spring-engaging ball within said housing for selectively adjusting the biasing force created by said compression spring.

21. A yarn tension control device according to claim 20, wherein said cam wheel defines a plurality of circumferentially spaced cam surfaces of varying depth.

22. A yarn tension control device for controlling tension in a running yarn, said tension control device comprising:

a housing having a yarn guiding inlet for receiving running yarn at an unwinding tension from a yarn supply source, and a yarn guiding outlet for guiding the running yarn downstream at a delivery tension;

a pivoted rocker block carried by said housing, and defining a first yarn engaging surface;

a second yarn engaging surface defined by a fixed inside wall of said housing adjacent the first yarn engaging surface of said rocker block, and said first and second yarn engaging surfaces cooperating to frictionally engage opposite sides of the running yarn along a path of travel through said housing;

said first and second yarn engaging surfaces defining a respective plurality of sequentially spaced friction rolls;

a compression spring for resiliently urging said first yarn engaging surface of said rocker block towards said second yarn engaging surface of said housing, wherein said opposing friction rolls cooperate to form a plurality of sequentially spaced nip points adapted to adjust yarn delivery tension in response to stress variations in running yarn entering said housing, and said compression spring being axially oriented to create a biasing force acting adjacent the sequentially spaced nip points, such that greater frictional resistance is applied at said nip points to running yarn at a relatively low degree of unwinding tension, and lesser frictional resistance is applied at said nip points to running yarn at a relatively high degree of unwinding tension;

wherein said yarn guiding inlet and said yarn guiding outlet are both longitudinally offset from the sequentially spaced nip points along the path of yarn travel through said housing;

a rotatable cam wheel and spring-engaging ball within said housing for selectively adjusting the biasing force created by said compression spring; and a yarn cleaner located upstream of said housing.

23. A yarn tension control device according to claim 22, wherein said cam wheel defines a plurality of circumferentially spaced cam surfaces of varying depth.

* * * * *